United States Patent [19]

Boni

[11] Patent Number: 4,461,937

[45] Date of Patent: Jul. 24, 1984

[54] FAIL-SAFE HYDRAULICALLY OPERATED CIRCUIT BREAKER ACCUMULATOR ARRANGEMENT

[75] Inventor: Richard R. Boni, McMurray, Pa.

[73] Assignee: McGraw-Edison Company, Rolling Meadows, Ill.

[21] Appl. No.: 303,557

[22] Filed: Sep. 18, 1981

[51] Int. Cl.[3] ..... H01H 35/38

[52] U.S. Cl. ..... 200/82 B; 200/148 B

[58] Field of Search ..... 200/82 B, 148 B, 148 F, 200/148 G, 148 E

[56] References Cited

U.S. PATENT DOCUMENTS

| | | | |
|---|---|---|---|
| 3,008,017 | 11/1961 | Strom et al. | 200/82 B |
| 3,345,487 | 10/1967 | Strom | 200/148 B |
| 3,832,502 | 8/1974 | Grieger et al. | 200/82 B |

*Primary Examiner*—J. R. Scott

*Attorney, Agent, or Firm*—James A. Gabala; Jon Gealow; Hugh Gilroy

[57] ABSTRACT

A contact operating mechanism is disclosed which employs a hydraulic motor means for moving contact members between closed and tripped positions, an accumulator for supplying hydraulic fluid under pressure to the motor means, and a separate gas supply means in fluid communication with the accumulator. The accumulator includes a piston or separating means for dividing the interior of the accumulator into two separate pressure chambers. One of the pressure chambers is connected to the hydraulic motor means and the other is connected to the gas supply means. Preferably, the gas supply means is separately disposed from and permanently connected to the accumulator with a sufficient volume of pressurized gas such that in the event that the piston repositions so as to completely fill the accumulator with hydraulic fluid sufficient gas under pressure is available to stroke the accumulator piston and operate the motor means. A pressure indicating means, such as a pressure activated switch or gage, when connected to the gas supply means provides a means of monitoring minimum gas energy even if the accumulator should completely fill with hydraulic fluid.

13 Claims, 4 Drawing Figures

FAIL-SAFE HYDRAULICALLY OPERATED CIRCUIT BREAKER ACCUMULATOR ARRANGEMENT

TECHNICAL FIELD

This invention relates, generally, to circuit breakers and, more particularly, to circuit breakers and interrupters having hydraulically operated mechanisms to open and close the electrical current carrying contacts.

BACKGROUND OF THE INVENTION

A power circuit breaker or circuit interrupter can be divided into three major components:

1. arc-interrupting and current-carrying contacts;
2. entrance bushings; and
3. an operating mechanism (operator).

Each of these components is vital to the operation of a circuit breaker; weakness in any one will result in unsuccessful breaker operation. After a circuit breaker has been placed in service, practical experience has shown that the operating mechanism requires the most attention.

The basic function of the operating mechanism is to open and close the breaker contacts. This, by itself, is a comparatively simple task. However, circuit breaker operating mechanisms are usually specified to meet the following design criteria:

1. Close contacts against the magnetic force resulting from the maximum momentary-current rating and against any spring pressure that may be used as an opening energy source within a time range of 10 to 15 A.C. cycles (0.166 to 0.250 seconds);
2. Allow contacts to open against inertial, frictional, and pressure forces at a speed that will result in 2 to 8 cycle (0.033 to 0.133 seconds) interruption of current and meet the prescribed velocities and time position requirements of the associated interrupter;
3. Allow contacts to open and then reclose in a total time of 15 to 30 cycles (0.25 to 0.50 seconds);
4. Perform at least five closing and opening operations without the energization of a prime mover;
5. Operate in climates having temperature variations of as much as −30° C. to +40° C. and in locations that vary from very dry and dusty to very hot and humid;
6. Be able to stand idle for periods up to a year, then operate the very first time at full speed and power;
7. Require low control currents;
8. Be economical to produce and maintain; and
9. Require little if no periodic maintenance for reliable operation.

The internal mass of the contacts, arc extinguishing gas compressive elements, connecting linkages, and the like in a large circuit breaker is considerable. A relatively large amount of energy is required to start any movement—especially in the short interrupting time required of a modern circuit breaker.

At present, there are four types of operating mechanisms (operators) used to operate high-voltage circuit breakers:

1. solenoid,
2. spring,
3. pneumatic, and
4. hydraulic.

The solenoid operator uses a large electric solenoid as a source of energy for closing. The solenoid requires large current inputs and is relatively slow. Generally used on small breakers, the solenoid operator is losing its importance. Although a solenoid operator requires no charge-up time, it cannot operate after loss of control power.

A spring operating mechanism stores energy in springs that are compressed by action of an electric motor. It is generally used for small distribution breakers where it is replacing the solenoid operator.

All the large circuit breakers requiring high-speed interrupting and high-speed reclosing use either a pneumatic or a hydraulic operating mechanism. These two types are similar enough to be discussed at the same time, using comparison as a means of pointing out differences.

The basic source of stored energy is the same for both the pneumatic and hydraulic operator: a compressed gas. The pneumatic operator compresses air by means of an electric, motor-driven, air compressor; the hydraulic operating mechanism operates with a gas compressed in an accumulator by means of an electric, motor-driven, oil pump. In a hydraulic operator sufficient energy is stored in an accumulator for several trip cycles. Unfortunately, the inherent limitations of accumulators are not taken into consideration when many hydraulic operating mechanisms are designed.

One major difference between pneumatic operators and hydraulic operators is the manner in which the gas is used: pneumatic operators are low-pressure (150 to 300 psi), high-volume gas systems; hydraulic operators have high-pressure (1500 to 5000 psi), low-volume gas systems. A comparison of the time required to charge the two gas systems from zero to full operating pressure shows that, depending on the size of the operating mechanism, it takes 40 to 60 minutes to charge a pneumatic system, while the gas system of a hydraulic accumulator is charged in about 8 to 15 minutes.

Another major difference between the two systems is that the hydraulic operator is basically a closed system; that is, in the absence of leaks gas never leaves the accumulator and the oil travels from a sump into the accumulator and back to the sump. Thus, there is little chance for foreign contamination. The pneumatic operator on the other hand, takes air from the atmosphere, compresses it, and then expels it back into the atmosphere. During compression, the moisture is condensed and accumulates in the gas system. This moisture must be removed regularly, depending upon atmospheric conditions. In cold climates, it must be kept from freezing or the valves in the operating mechanism may become inoperative. In warm, humid climates, water is condensed on metal surfaces similar to that often seen coming out of air conditioners. Naturally, this leads to internal corrosion. The moisture problem is probably the biggest source of trouble for maintenance people. For these two reasons alone, hydraulic accumulators are by far the preferred source of fluid energy to operate large circuit breakers.

In addition to a source of fluid, hydraulic accumulators also provide several other useful functions. Since all hydraulic systems eventually develop leaks, the accumulator compensates for external leakage and thereby maintains hydraulic pressure within an acceptable range for long periods of time. In the same manner, the accumulator compensates for thermal expansion and contraction of the liquid due to variations in temperature. Finally, the accumulator also dampens pressure surges caused by the electrically driven hydraulic pump when it is cycled on and off. This prevents damage to the components of the hydraulic system caused by vibration and shock. Not all accumulator designs (i.e. spring operated, gravity operated) are especially adopted to use as an emergency source of hydraulic power for a circuit breaker. Gas-operated accumulators are preferred.

Gas-operated accumulators are often referred to as pneumatic or hydropneumatic accumulators. Gas-operated accumulators are classified as either non-separator or separator types. In the nonseparator type accumulator, no means are provided for separating the gas from the liquid. In the separator type of gas-operated accumulator, a dividing means or separator is provided to separate the gas from the liquid. Three types of separators are used: a bladder or bag; a diaphragm; or a piston (e.g. U.S. Pat. No. 3,136,340).

Unfortunately, the rubber diaphragm in the diaphragm accumulator and the soft rubber bladder or bag in the bladder accumulator leaks gas by osmosis. This leakage can amount to almost 10% per year. Thus, the gas space in each of these accumulators must be periodically charged. This is an unnecessary nuisance and inconvenience. It is also possible for the bladder to rupture. In addition, these accumulators must be visually examined periodically for indications of hydraulic leaks in that the soft rubber bladder or diaphragm can easily leak. If the separating material fails, the accumulator must be removed, repaired, and reinstalled. This is a relatively complicated and time consuming task.

Before a bladder or diaphragm can be repaired, all internal pressure must be relieved. In addition, the air or gas in the accumulator must be discharged. It should be appreciated that the time that an electrical distribution system is placed out of service is inevitably long. Thus, the preferred accumulator in a hydraulically operated circuit breaker is a piston type gas-operated accumulator. Unfortunately, piston accumulators as used in circuit breakers have not been used to their greatest advantage. Moreover, some of their inherent limitations are frequently compensated for by other components. An innovative approach to the manner in which conventional accumulators can be used would go far towards improving the overall reliability of hydraulically operated circuit breakers.

SUMMARY OF INVENTION

In accordance with the present invention, an operating mechanism is provided to operate the current carrying contacts of a circuit breaker or interrupter. The operating mechanism includes: a hydraulic motor for physically opening and closing the current carrying contacts; a pumping means or pump for supplying hydraulic fluid under pressure; a piston-type gas-operated accumulator for storing fluid energy and for operating the hydraulic motor means; and a gas supply means or tank for providing a source of pressurized gas to the accumulator the volume of which is not affected by the position of the piston in the accumulator.

Under normal conditions, the pump is not operating and the accumulator provides a source of fluid energy for operating the hydraulic motor whenever the need should arise. The hydraulic accumulator includes a cylindrical housing into which a piston is sealingly disposed so as to be free to move between the two ends of the cylinder. The piston divides the accumulator into two pressure chambers, one of which is filled with hydraulic fluid and is in communication with the pump and the motor, the second of which is in fluid communication with the gas supply means or tank. When the pump is placed in operation, the accumulator is charged and the gas end of the accumulator is compressed. Preferably the gas supply means is separately disposed from and permanently connected to the accumulator. This arrangement prevents the piston in the accumulator from totally collapsing the gas space or chamber even in the event that the accumulator is so overcharged that it completely fills with hydraulic oil, or in the event that an air or gas leak develops such that the piston comes in contact with the gas end of the accumulator. By providing an indicating means, such as a gas gauge, and/or a pressure actuated alarm device, such as a pressure switch triggered alarm, operating personnel can be alerted when gas pressure drops below that which is sufficient to operate the hydraulic motor through several trip cycles. This feature is especially important in the event that the hydraulic pump could not keep the accumulator charged. If the gas supply means or tank were not separately disposed from and permanently connected to the accumulator, the hydraulic pump would attempt to keep the accumulator charged at a pressure at least equal to the output pressure of the hydraulic pump until all or part of the air or gas on the other side of the piston within the accumulator was depleted. Since the pumping capacity of the hydraulic pump is typically less than that of the accumulator, the circuit breaker could not be safely operated. This is an especially important feature when the circuit breaker is relatively remote from maintenance personnel, or if the circuit breaker forms part of a transmission grid which cannot be easily taken out of service without causing a wide spread power outage or if used in a circuit supplying power to a critical or important load.

Numerous other advantages and features of the present invention will become readily apparent from the following detailed description of the invention and the embodiments thereof, from the claims and from the accompanying drawings.

DETAILED DESCRIPTION OF THE INVENTION

While this invention will be described in connection with a preferred embodiment, it should be understood that it is not intended to limit the invention to that specific embodiment. On the contrary, it is intended to cover all alternatives, modifications, and equivalents as may be included within the spirit and scope of the invention as defined by the appended claims. It should be understood that the present disclosure is to be considered as an exemplification of the principles of the invention.

Figure 1:
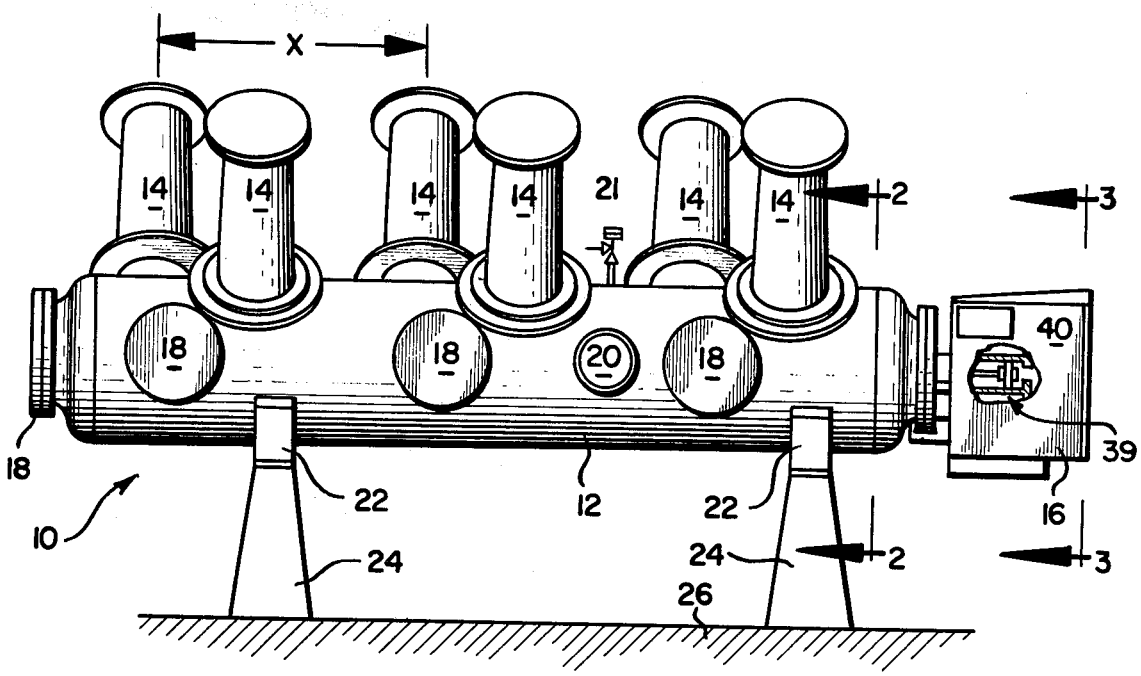
FIG. 1 is a side elevational view of a advanced puffer interrupter circuit breaker operated by an hydraulic operating mechanism of the type forming the subject matter of the invention.

FIG. 1 shows a modern 145 KV puffer type $SF_6$ circuit interrupter 10 of a dead tank design. A single 3 foot diameter tank 12 is used to house three puffer interrupters which are arranged in tandem (i.e. one puffer interrupter for each phase). The compact and efficient arrangement is clearly illustrated in FIG. 1. In particular, six entrance bushings 14 enter the tank 12 at a seventeen degree angle (see FIG. 2) with their upper ends separated approximately two feet. The phase spacing "X" is 5½ by comparison. The overall dimensions are 13 feet high, 6 feet wide, and 21 feet long. Its weight is approximately 16,000 pounds.

The tank 12 serves as a base or frame upon which the major components of the interrupter 10 are attached. One end of the tank 12 supports a hydraulically powered operating mechanism 16 which is used to cycle the three puffers. The tank 12 itself is provided with a plurality of access ports 18 on each side (see FIG. 2) to facilitate maintenance and adjustment of the puffers and the connections to the operating mechanism 16. The tank 12 also is provided with a rupture disk 20 and a relief valve 21 to protect it from an overpressure condition. Two saddles or yokes 22, which are adapted to be joined to a set of piers or tank supports 24, hold the tank at a spaced distance from the ground or grade 26.

Figure 2:
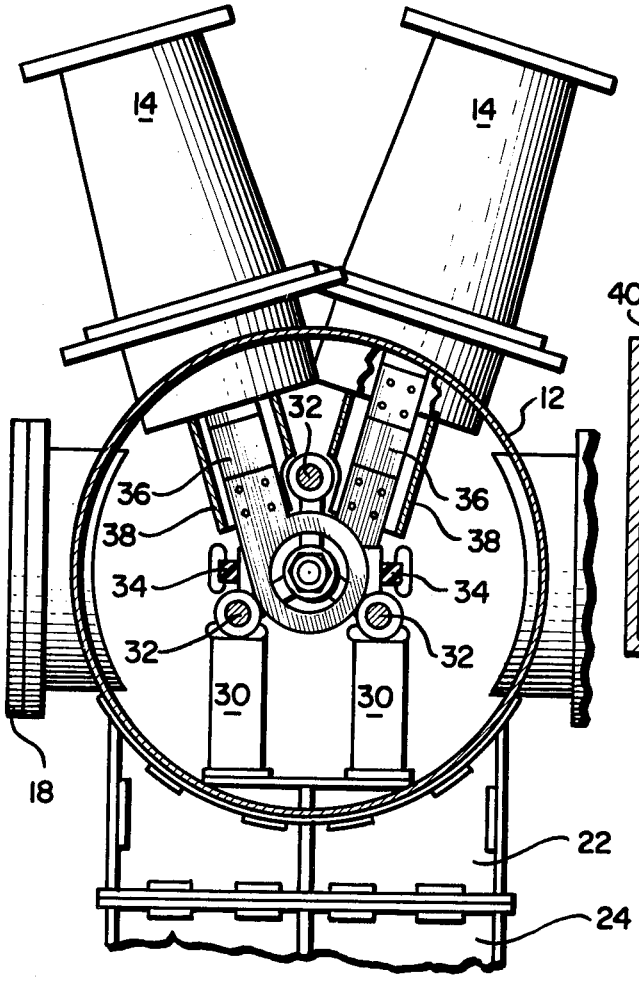
FIG. 2 is a cut away view of the front end of the puffer interrrupter shown in FIG. 1 as viewed along line 2—2.

Referring to FIG. 2, each puffer assembly 28 is supported off or at a spaced distance from the tank walls by three pairs of cast epoxy standoff insulators 30. The puffer assemblies themselves are supported and axially positioned relative to one another by three hollow insulating and support tubes 32. The support tubes 32, in turn, are attached to the standoff insulators 30. The moving portion of each puffer assembly is reciprocated by a pair of insulated operating rods 34, which, in turn, are operated by the hydraulic operating mechanism 16. The inside terminals of the entrance bushings 14 are connected to their associated puffer assembly 28 by a set of flexible connectors 36 housed within a corona shield 38 carried by the entrance bushings.

Figure 3:
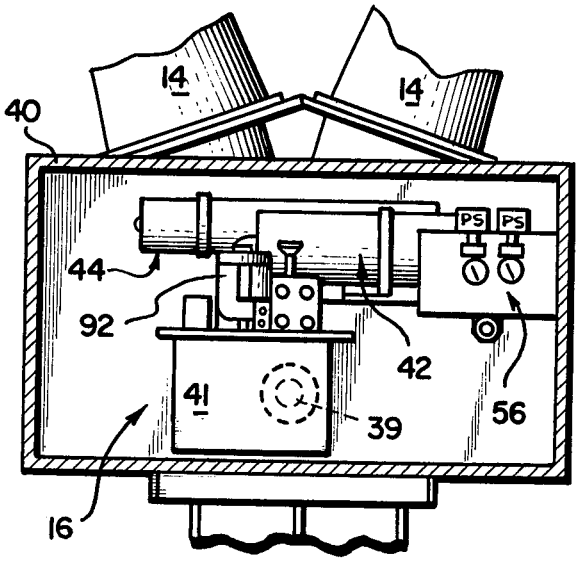
FIG. 3 is a front elevational view of the hydraulic operating mechanism shown in FIG. 1 as viewed along line 3—3.

FIG. 3 depicts the hydraulic operating mechanism 16. In this particular embodiment one, high-speed, double-acting piston operator or hydraulic motor 39 is used to stroke all three puffer assemblies simultaneously. The two operating rods 34 are connected to one end of the hydraulic motor 39. All of the major operating components are mounted in a metal housing 40. The cover of the hydraulic sump or tank 41 is used to mount the various hydraulic valves (see FIG. 4) and the hydraulic motor 39. This allows the operating mechanism 16 to be shipped completely assembled and mounted on the main tank 12. The single, double-acting piston operator 39 functions as a dashpot for absorbing shock at the end of the opening and closing strokes. The circuit breaker contacts 95 are hydraulically latched open by the pressure differential across the operating piston 82 (see FIG. 4) in the piston operator. The differential area across the operating piston 82 (i.e., the effective area of that face of the piston to which the operating rod is connected has a smaller area than the other side, the so called "blind side") holds the breaker contacts closed. A relatively small (4.5 gallon) piston-type, gas-operated accumulator 42 stores compressed nitrogen gas on one side of a piston 46 and hydraulic oil on the other. Preferably, the size of the accumulator 42 is selected so that it has a storage capacity capable of providing fluid energy for five closing operations without requiring the associated electrically powered hydraulic oil pump or charging pump 43. A nitrogen tank or gas storage bottle 44 is connected to the gas side of the accumulator 42. All the associated controls are carried within the housing 40. In the embodiment illustrated, the hydraulic motor 39 has a 3½" bore and a 7" stroke. The opening speed is approximately 22 ft/sec and the closing speed is about 12 ft/sec when the accumulator 42 and nitrogen tank 44 are charged to 3150 psi.

To fully appreciate the present invention, the general principles of operation of a typical hydraulically powered operating mechanism 16 should be understood.

Figure 4:
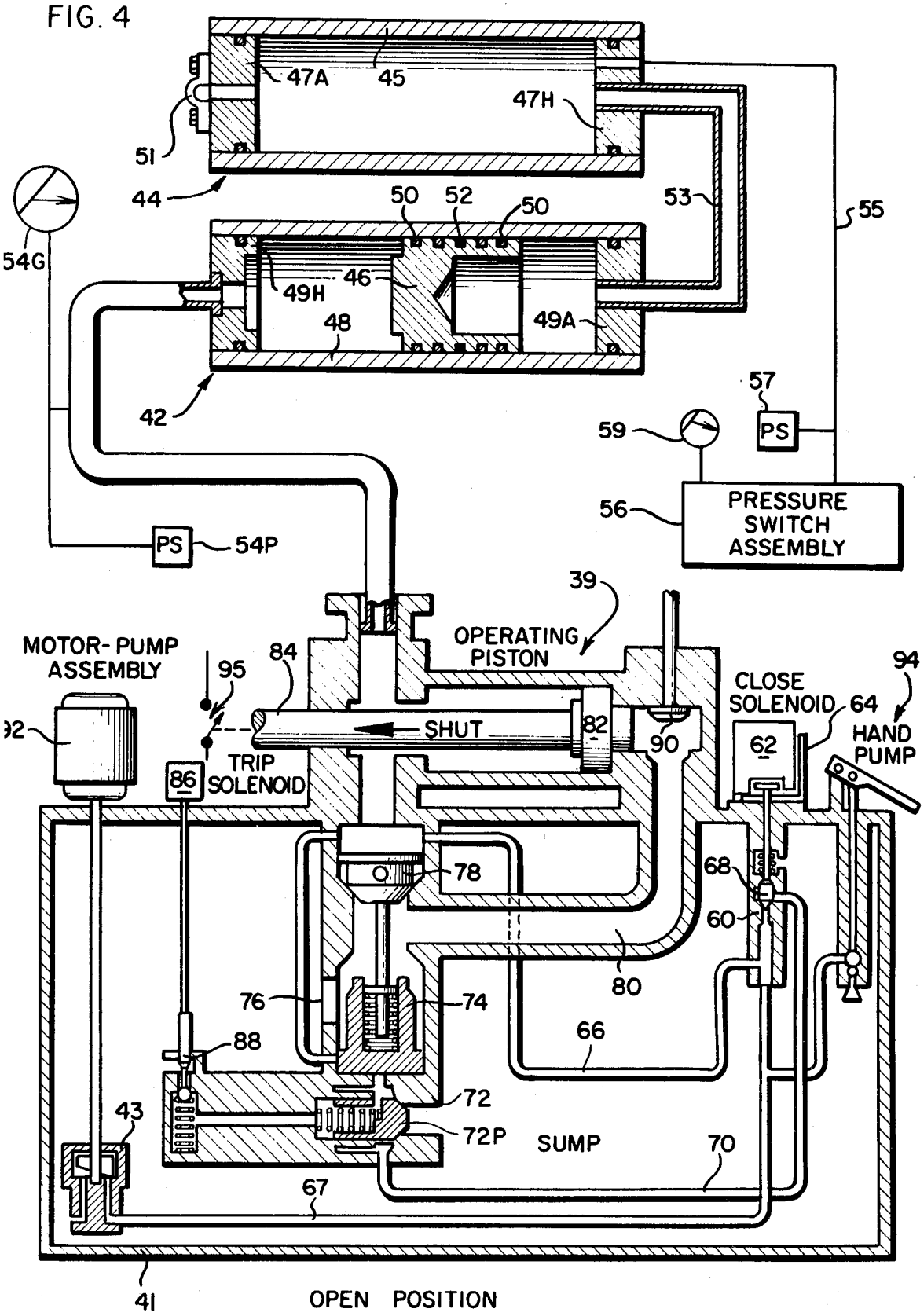
FIG. 4 is a schematic drawing of the hydraulic operating mechanism shown in FIG. 3.

Referring to FIG. 4, to initiate a breaker closing operation, a spring loaded pilot valve 60 is raised by a closing coil 62 or a manual closing lever 64. This allows hydraulic oil to flow from the accumulator 42 through an accumulator pilot supply line 66. Once the pilot valve 60 is raised, the oil pressure on the bottom of the pilot valve stem 68 holds the pilot valve open against spring pressure. The high-presssure hydraulic oil then flows through a small pilot line 70 and around a closed poppet valve 72 to hydraulically load a large relay piston 74. When so loaded the relay piston 74 moves up to seal off an exhaust port 76, which is open to the sump 41, and open a relay valve 78 allowing high pressure hydraulic fluid 80 from the accumulator 42 to flow to the blind side of the operating piston 82 in the hydraulic motor 39, thereby closing the interrupter contacts 95. Although the pressure is the same on both sides of the operating piston 82, the pressure area differential (equal to the operating rod 84 area) provides the force for closing the contacts 95.

Once the breaker contacts 95 are shut, hydraulic pressure holds them shut. This is because both sides of the operating piston 82 are now in fluid communication with the accumulator 42. The pressure-force applied to the operating piston 82 is preferably strong enough to hold the breaker contacts 95 closed against a fault current even at minimum hydraulic pressure.

The tripping operation is accomplished through the activation of a trip coil 86 which depresses a ball valve 88 which allows the spring loaded plug 72P within the poppet valve 72 to reposition, thereby relieving pressure from the small pilot line 70. This allows the relay valve 78 and piston 74 to move down sealing-off the accumulator 42 and exhausting the blind side of the operating piston 82 to the sump tank 41 (via exhaust port 76). Reduction of pressure in the small pilot line 70 allows the spring loaded closing pilot valve 60 to reset and seal-off the oil supply line 66 from the accumulator 42.

The breaker contacts 95 can be slow opened or closed by sealing off the blind side of the operating piston 82 with an isolating valve 90 and adding or removing high pressure oil through special maintenance valves (not shown for purposes of clarity). FIG. 4 also shows a small electric motor 92 which is used to drive a hydraulic pump 43 to charge the hydraulic system accumulator 42 should the pressure drop too low to its operating pressure. A manual hand pump 94 is also provided for charging the accumulator 42 when the motor 92 is inoperative and personnel are available.

Now that the basic operation of the operating mechanism is understood, the internal construction of the accumulator 42 will be described. Referring to FIG. 4, the accumulator 42 consists of a cylindrical housing or barrel assembly 48, a free-floating piston 46, and two end cap assemblies 49H and 49A. The barrel assembly 48 houses the piston 46 and incorporates provisions for securing the two end caps 46H and 49A. The tight-fitting piston 46 sealingly rides on two Teflon sealing rings 50 and is girdled about its center by a V-O ring 52 (an O-ring with flutes on both sides) that gives positive wiping action on the cylindrical walls and a seal between the hydraulic fluid at one end of the accumulator and the nitrogen gas at the other end. When in the static state—the piston 46 is at rest but not bottomed—equal pressures exist on both sides on the seals; thus, there is no pressure difference to cause gas migration.

A pressure switch 54P is used to trigger the charging pump 43 into operation when hydraulic pressure drops too low. A gage 54G provides local indication of hydraulic pressure. Although not shown in FIG. 4, it is customary in such installations to provide a low pressure dump valve. This is a mechanical device which prevents the breaker contacts from being closed when the accumulator presssure becomes too low. When such a valve is incorporated and the hydraulic pressure drops below allowable limits during a closing operation, the low pressure dump valve acts to trip the breaker. It also prevents closing if pressure dropped beforehand.

Turning to the gas storage tank 44, its construction is similar to that of the accumulator 42 with the exception of the piston 46. In particular, the storage tank 44 consists of a housing or barrel assembly 45, two end cap assemblies 47H and 47A; and a charging connection 51. Like the accumulator barrel assembly 48, the gas storage tank barrel assembly 45 incorporates provisions for securing the two end caps 47H and 47A so as to form a pressure-tight enclosure. In one embodiment, it has a 4 gallon capacity. One end cap 47A carries a charging connection or valve 51 which is used to fill the tank with gas. The other end cap 47H is provided with a fitting for connecting a line 53 to the accumulator 42 and a fitting for connecting a line 55 to a pressure switch assembly 56. The pressure switch assembly 56 preferably includes a gage 59 to monitor tank pressure and a pressure switch 56 which is electrically connected to the trip coil 86 in such a manner that if the accumulator pressure drops below a certain minimum pressure, the breaker will be signaled to trip. Preferable, an additional set of contacts are provided to block a closing signal. A separate pressure switch 57 may be used to actuate a remote alarm. This set point is preferably above that pressure on the hydraulic side of the accumulator 42 such that it anticipates the pressure getting so low that no more than one operation of breaker contacts 95 can be completed. If, for some reason the pressure switch assembly 56 fails to operate, the low pressure dump valve would then act to trip the breaker. The purpose of both safety devices is to prevent slow opening of the breaker because of a loss of hydraulic pressure.

In the operation of pneumatic type accumulators, the compressed air chamber is inflated with air or preferably dry nitrogen to a predetermined pressure that is somewhat lower than system pressure before hydraulic pressure is raised. This pressure is stipulated by the system manufacturer and is referred to as the "accumulator preload."

As an example of accumulator operation, assume that an accumulator 42 is designed for a preload of 1700 psi in a 3150 psi hydraulic system. The hydraulic system pressure should be zero when the initial charge of 1700 psi preload is introduced into the air side of the accumulator piston 46. The pressure gage 59 is used to check the preload. As gas pressure is applied to the storage tank 44 through the charging connection 51, the piston 46 moves toward the end cap 49H at the opposite end. The 1700 psi preload moves the piston 46 to the extent that the volume of gas under pressure completely fills the accumulator housing 48. After the accumulator 42 has been preloaded to 1700 psi, the hydraulic oil pump 43 is started to force fluid against the piston 46 in the accumulator (i.e. through oil lines 67 and 66). Hydraulic system pressure must increase to a pressure greater than 1700 psi before the hydraulic fluid can move the piston 46. Thus, at 1701 psi the piston 46 will start to move within the accumulator 42 towards the opposite end cap 49A, compressing the gas as it moves. In one embodiment the capacity of the accumulator 42 and the storage tank 44 are such that at approximately 3150 psi, the gas will be compressed to the extent that it occupies only 15% of the volume of the accumulator that it did at 1700 psi. This is in contrast to usual practice where the piston is approximately midway between the two end caps when the accumulator is fully charged.

When actuation of the hydraulic motor 39 lowers hydraulic operating mechanism 16 system pressure, it is evident that the compressed gas in the accumulator 42 and the gas storage tank 44 will expand against the piston 46, forcing hydraulic fluid from the accumulator, thus providing an instantaneous supply of pressurized fluid to the hydraulic motor.

Those skilled in the art know that it is standard practice to use an accumulator 42 not having a gas storage tank 44 permanently connected to and separately disposed from the gas or air side of the piston 46 in the accumulator. Under such an arrangement, if a gas leak should develop, the piston 46 would reposition so as to maintain equal pressure on either of its two faces. Because the hydraulic fluid is virtually incompressible, the piston 46 would move a relatively short distance. If the hydraulic pump 43 is energized in a effort to maintain pressure, the accumulator would gradually fill with fluid. Eventually, the point would be reached where the piston 46 would come in contact with the end cap 49A on the air or gas side of the accumulator. Once this occurs, the hydraulic system would effectively be a "solid system" whose pressure would change dramatically due to any change in volume. If the hydraulic motor 39 should be cycled, hydraulic pressure would drop rapidly. As the hydraulic pressure dropped, the hydraulic pump 43 would eventually be triggered into operation in an effort to charge or maintain hydraulic system pressure above the minimum necessary for proper operation of the hydraulic motor 39. However, the pump 43 does not have the same capacity as the motor. Therefore, the loss of pressure on the gas side of the piston would preclude subsequent safe operation of the hydraulic motor 39, especially in the event that the hydraulic pump 43 became inoperative or in the event that electrical power were cut off to the hydraulic pump motor 92. The same is true if the air or gas leak is so rapid that the accumulator cannot be completely filled with fluid from the pump before all gas pressure is lost.

Under the arrangement shown in FIG. 4, a separately disposed gas storage tank 44 which is permanently connected to the air or gas side of the accumulator 42, forecloses that sequence of events from occurring. Effectively, the gas storage tank 44 when properly charged to the required preload pressure, provides a minimum amount of stored energy which will insure that pressure is applied to the hydraulic system for at least one cycling of the breaker contacts 95, even in the event that the hydraulic pump 43 should fail or become inoperative when the accumulator piston 46 is against the end cap 49A at the air side of the accumulator 42. The pressure switch assembly 56 when set just above that pressure needed to drive the operating piston 82 to trip the breaker contacts 95 will preclude the breaker contacts 95 from slow opening while current is being passed. This innovative approach to the design of hydraulic operating mechanisms for circuit breakers is especially useful in that it adds an additional margin of safety and adds to the overall reliability of the device at very little expense.

From the foregoing description, it should be clear that there are many advantages to the present invention.

Compact: The hydraulic operating mechanism 16 is small in size. A separately disposed gas storage tank 44 and accumulator 42 when mounted side by side require a minimally sized housing 40.

High Speed: Hydraulic oil under pressure provides a mechanically rigid link between the stored energy piston 46 in the accumulator 42 and the operating piston 82.

Smooth Operation: The hydraulic operating piston 82 absorbs shock during both closing and opening, resulting in very little contact bounce or hammering.

Indication of Stored Energy Capability: By monitoring the pressure in the gas storage tank 44 the energy available to operate the accumulator piston 46 can be monitored without directly measuring the position of the accumulator piston.

Fail Safe Operation: A minimum volume of gas is guaranteed because the accumulator piston is confined to the accumulator and a separately disposed and permanently connected gas storage tank 44 is used.

Preload Indication: Those skilled in the art know that it is generally assumed that if precharge pressure is going to be lost at all, it would be at the beginning of equipment life. Thus, precharge pressure was more often than not checked only at the time of installation. Typically, only sump 41 level was checked. If the level was too low, some preload may have been lost, allowing the accumulator piston to rise too far. Ordinarily, a sump gage was provided that was marked as to proper fluid level for several pressures and temperatures. Since it is more probable that an oil leak had developed, the usual practice was to add oil. Adding oil only masks a gas leak. Thus, conventional systems did not provide a means for ensuring that the operating mechanism would safely operate when required.

From the foregoing, it will be observed that numerous variations and modifications may be effected without departing from the true spirit and scope of the novel concept of the invention. For example, although a specially fabricated gas storage tank 44 is illustrated, a standard gas storage tank or bottle and charging connection may be conveniently connected to the end cap 49A at the gas side of the accumulator 42. Such a bottle or tank can be brought down to the desired preset pressure and then left permanently installed. Thus, it is to be understood that no limitation with respect to the specific apparatus illustrated is intended or should be inferred. It is, of course, intended to cover by the appended claims all such modifications as fall within the scope of the claims.

What is claimed is as follows:

1. In a circuit breaker having an interrupting unit carried within a housing, the interrupting unit having an electrical contact member which is movable between a closed and a tripped position, a contact operating mechanism:

a. hydraulic motor means, operating in response to pressurized fluid supplied thereto, for moving said electrical contact member between its closed and tripped positions;

b. an accumulator, in fluid communication with said motor means, for storing hydraulic fluid under pressure, said accumulator defining a housing and stroking means for dividing the interior of said housing into two pressure chambers, one of said pressure chambers being in fluid communication with said motor means and with the second pressure chamber filled with a gas; and c. gas supply means, separately disposed from said accumulator, for supplying gas under pressure to said second pressure chamber, said gas supply means defining a fixed volume of gas which for a pre-selected pressure provides sufficient energy to the hydraulic fluid in said first pressure chamber to operate said motor means to move said contact member between its closed position and its tripped position.

2. The operating mechanism set forth in claim 1, further including pump means in fluid communication with said motor means and said accumulator, for charging said accumulator.

3. The operating mechanism set forth in claim 1, wherein said stroking means is a piston sealingly and reciprocatingly disposed within a cylindrical housing so as to be free to move between a full and an empty position, said pre-selected pressure being established when said piston is in its full position, whereby so long as the pressure in said gas supply means is above said pre-selected pressure sufficient energy is available to operate said hydraulic motor means.

4. In a circuit breaker having a plurality of interrupting units carried within a housing with each of said interrupting units defining a movable contact member, an operating mechanism:

a. hydraulic motor means for moving each contact member between a closed and a tripped position in response to hydraulic fluid supplied thereto;

b. an accumulator, in fluid communication with said hydraulic motor means, having a housing and piston means disposed within said housing so as to form two pressure chambers, one of said pressure chambers being in fluid communication with said motor means and the second of said pressure chambers being filled with a gas, said piston being movable within said housing between a first position where the volume of said first pressure chamber is a minimum and the volume of said second pressure chamber is a maximum and a second position where the volume of said first pressure chamber is at a maximum and the volume of said second pressure chamber is at a minimum; and c. gas supply means for supplying gas under pressure to said second pressure chamber within said accumulator, said gas supply means defining a volume of gas under a set pressure which, in the event that said piston means is in its second position provides sufficient energy to drive said piston means from said second position to a position intermediate said first and second positions to operate said motor means and move said contact members between said closed and said tripped positions, whereby slow opening of said contact members is precluded.

5. The operating mechanism set forth in claim 4, further including: indicator means, in fluid communication with said gas supply means, for indicating the pressure of the gas within said gas supply means, said indicator means defining a first set point when said piston means is in its first position and a second set point which is higher than said first set point when said piston means is in its second position, whereby in the event that said indicator means indicates a pressure less than said first set point inadequate gas energy is available to operate said motor means.

6. In a circuit breaker having a plurality of interrupting units carried within a housing with each of said interrupting units defining a reciprocating contact member movable between a tripped and closed position, an operating mechanism:

a. hydraulic motor means for moving each of said contact members simultaneously between one of said tripped and closed positions to the other;

b. an accumulator having a cylindrical housing and a reciprocating piston sealingly disposed within said housing so as to form a pressure chamber at each end of said housing, one of said pressure chambers being in fluid communication with said motor means and the second of said pressure chambers being filled with gas;

c. pump means, in fluid communication with said motor means and said one pressure chamber, for supplying hydraulic fluid to charge said accumulator; and d. a gas bottle separately disposed from said accumulator and in fluid communication with said second pressure chamber, said gas bottle defining a preselected quantity of gas with sufficient volume and pressure to displace said piston and operate said motor means, whereby the volume of gas in said gas bottle is unaffected by the position of said piston in supplying fluid to said motor means even in the event that said accumulator is entirely filled with hydraulic fluid, and in said event a sufficient quantity of gas is available to operate said motor means provided the pressure of said gas is above said pre-selected pressure setting.

7. In an electrical circuit interrupter having a contact member movable between a tripped and a closed position, an operating mechanism for said interrupter, comprising:

a. hydraulic motor means for moving said contact member between one of said tripped and said closed positions and the other of said tripped and said closed positions, a first volume of fluid being displaced by said motor means in moving said contacts from said one position to said other position;

b. hydraulic pump means for supplying hydraulic fluid under pressure at a volume generally less than said first volume;

c. an energizable prime mover for driving said pump means;

d. an accumulator including a hollow housing defining an interior volume and a movable housing dividing means, disposed within said housing, for dividing said housing into two pressure chambers, one of said pressure chambers being in fluid communication with said motor means and said pump means and the second pressure chamber being filled with gas, said dividing means being movable between a first position where the volume of said one chamber is substantially equal to said interior volume and a second position where the volume of said second chamber is substantially equal to said interior volume, said interior volume being at least equal to said first volume;

e. a gas reservoir in fluid communication with said second chamber in said accumulator, said gas reservoir defining a preset volume of gas at a first pressure when said housing dividing means is at its first position, said first pressure and said preset volume being selected such that the volume of hydraulic fluid discharged from said first chamber by the pressure force applied to said hydraulic fluid by said dividing means when said prime mover is deenergized being at least equal to said first volume, whereby the volume of pressurized gas in communication with said dividing means is at least equal to said first volume regardless of the position of said dividing means and said interrupter if closed can be tripped at least once.

8. The operating mechanism set forth in claim 7, further including valve means, actuated in response to a control signal, for controlling the flow of hydraulic fluid to said motor means from said accumulator, said valve means having a first position and a second position, hydraulic fluid under pressure being supplied to said motor means when said valve means is in its first position to move said contact member to its tripped position, said valve means when in its second position directing hydraulic fluid to said motor means to move said contact member to its closed position.

9. The operating mechanism set forth in claim 7, wherein said gas reservoir is separately disposed from said accumulator.

10. The operating mechanism set forth in claim 7, further including first pressure indicating means for indicating the pressure in said gas reservoir, said first pressure indicating means defining a first pressure indication when said dividing means is in its second position and said second chamber is filled with gas at said first pressure, whereby a pressure indication less than first pressure indication signals inadequate gas pressure to trip said circuit interrupter.

11. The operating mechanism set forth in claim 7, wherein said accumulator housing is a cylinder, said housing divider means is a piston sealingly disposed within said cylinder, and said gas reservoir is a tank of pressurized nitrogen gas.

12. The operating mechanism set forth in claim 7, wherein said interior volume is equal to an even integral multiple of said first volume, whereby said contacts can be cycled between said closed and open positions at least once.

13. The operating mechanism set forth in claim 10, further including first trip means, actuated by said first pressure indicating means, for operating said motor means to trip said circuit interrupter when the pressure in said first chamber is less than the pressure corresponding to said first pressure indication, whereby slow opening is precluded.

* * * * *